US009951578B2

(12) United States Patent
Kitzman et al.

(10) Patent No.: US 9,951,578 B2
(45) Date of Patent: Apr. 24, 2018

(54) RADIALLY EXPANDABLE RATCHET LOCKING BOREHOLE BARRIER ASSEMBLY

(71) Applicant: BAKER HUGHES INCORPORATED, Houston, TX (US)

(72) Inventors: Jeffery D. Kitzman, Spring, TX (US); Steve Rosenblatt, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 198 days.

(21) Appl. No.: 14/887,936

(22) Filed: Oct. 20, 2015

(65) Prior Publication Data

US 2017/0107781 A1 Apr. 20, 2017

(51) Int. Cl.
*E21B 33/134* (2006.01)
*E21B 33/128* (2006.01)

(52) U.S. Cl.
CPC ..... *E21B 33/134* (2013.01); *E21B 33/1285* (2013.01)

(58) Field of Classification Search
CPC combination set(s) only.
See application file for complete search history.

(56) References Cited

U.S. PATENT DOCUMENTS 2,490,350 A 12/1949 Grable
3,746,093 A * 7/1973 Mullins ..... E21B 23/06 166/123
4,289,200 A * 9/1981 Fisher, Jr. ..... E21B 23/06 166/120
5,769,459 A * 6/1998 Graf ..... F16L 55/163 138/97
6,116,336 A 9/2000 Adkins et al.
7,387,170 B2 * 6/2008 Doane ..... E21B 23/06 166/134
7,464,764 B2 * 12/2008 Xu ..... E21B 34/14 166/317
7,861,781 B2 1/2011 D'Arcy
8,887,818 B1 11/2014 Carr et al.
9,045,963 B2 6/2015 Shkurti et al.

FOREIGN PATENT DOCUMENTS

EP 431689 A1 12/1991

* cited by examiner

*Primary Examiner* — Kyle Armstrong
(74) *Attorney, Agent, or Firm* — Steven Rosenblatt

(57) ABSTRACT

A borehole barrier comprises a scroll where the overlapping parts have a ratchet for radial expansion against a surrounding tubular with the ratchet controlling springing back. The outer surface can have carbide or other hard particles to penetrate the surrounding tubular for fixation. The end of the scroll forms a tapered ball seat. Expansion into place can be with a tool, or by releasing potential energy in the scroll or by using a shape memory alloy that enlarges at above its critical temperature. The scrolls can be removed by milling or allowed to dissolve or disintegrate with exposure to well fluids. The scroll design is quickly deployed and removed and is far more economical than known plugs that have the traditional seal and slip design. The balls can be milled out with their associated scrolls or flowed to the surface with produced fluids.

21 Claims, 2 Drawing Sheets

RADIALLY EXPANDABLE RATCHET LOCKING BOREHOLE BARRIER ASSEMBLY

FIELD OF THE INVENTION

The field of this invention is removable borehole barriers and more particularly barriers that can be used in plug and perforate systems involving an expandable ratcheting sleeve with an integrated ball seat.

BACKGROUND OF THE INVENTION

Fracturing using a plug and perforate method is well known. In this method barriers are delivered with a perforating gun and after the barrier is set the gun is repositioned and fired followed by a pressure treatment against the barrier. This process is repeated in an uphole direction until the entire zone of interest is treated. After that the plugs are generally drilled out. The process of drilling out the plugs is time consuming and the cost of the plugs can be substantial depending on the size of the borehole and how many plugs are required for the interval to be treated.

Ratchet mechanisms have been used in the past for allowing relative movement in a single direction. Some devices in the past have used ball seats in tools as distinct structures from ratchet rings. Generally ratchet rings are internal tool components that permit unidirectional relative movement between parts. Some examples are: U.S. Pat. No. 7,861,781; US 6,116,336 (FIG. 9); US 8,887,818 (FIG. 5); US 9,045,963 (FIG. 27); US 2,490,350 (FIGS. 2 and 4 and EP 0431689 A1 (FIG. 1).

What is needed and provided by the present invention is an economical way to provide barriers in the borehole coupled with a way they can be rapidly removed such as by drilling out or by other means such as disintegration. The barriers have a scroll shape to allow for radial expansion with one or opposed ratchet features to lock the enlarged dimension against a surrounding borehole. The scroll exterior can have hard facing or carbide or other materials that preferably penetrate the inside wall of the surrounding tubular for additional support. Expansion can be with a subterranean tool such as an inflatable, or potential energy trapped in the scroll can be released or the scroll can be made of a shape memory alloy that grows to meet the surrounding borehole when exposed to well temperatures above the critical temperature of the material. The scroll is flexible to tolerate some out of roundness of the surrounding tubular and the built in seat at an end allows a ball to land to stop most of the flow so pressure can build up for the treatment of the formation. In many applications complete sealing is not needed as long as high flows under high pressure can enter the formation. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A borehole barrier comprises a scroll where the overlapping parts have a ratchet for radial expansion against a surrounding tubular with the ratchet controlling springing back. The outer surface can have carbide or other hard particles to penetrate the surrounding tubular for fixation. The end of the scroll forms a tapered ball seat. Expansion into place can be with a tool, or by releasing potential energy in the scroll or by using a shape memory alloy that enlarges at above its critical temperature. The scrolls can be removed by milling or allowed to dissolve or disintegrate with exposure to well fluids. The scroll design is quickly deployed and removed and is far more economical than known plugs that have the traditional seal and slip design. The balls can be milled out with their associated scrolls or flowed to the surface with produced fluids.

DETAILED DESCRIPTION OF THE PREFERRED EMBODIMENT

Figure 1:
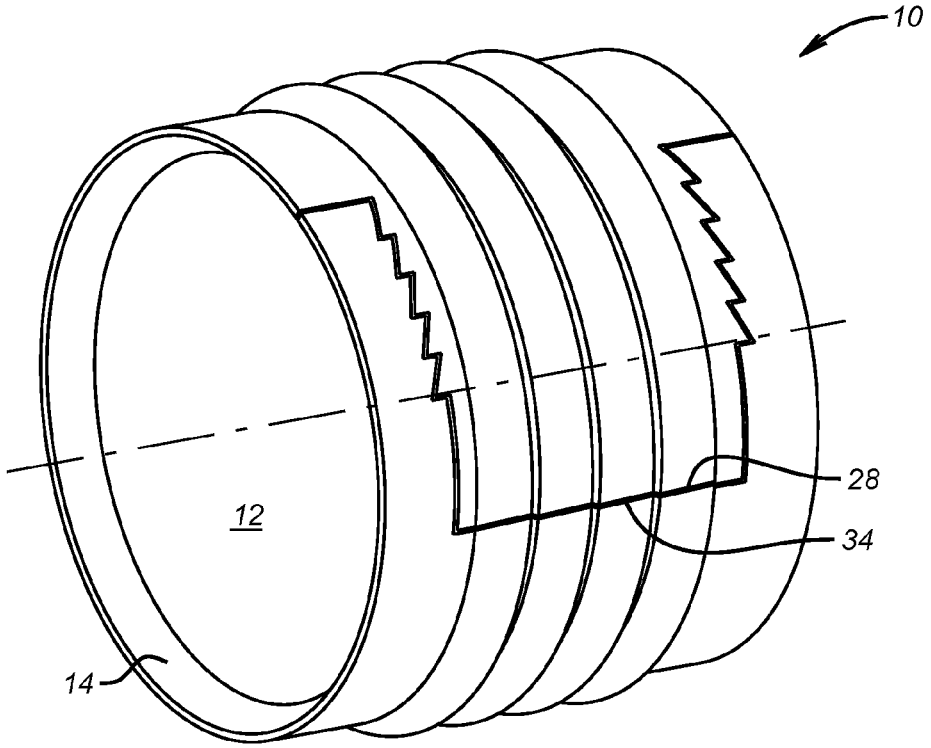
FIG. 1 is a run in perspective view of the scroll.
Figure 2:
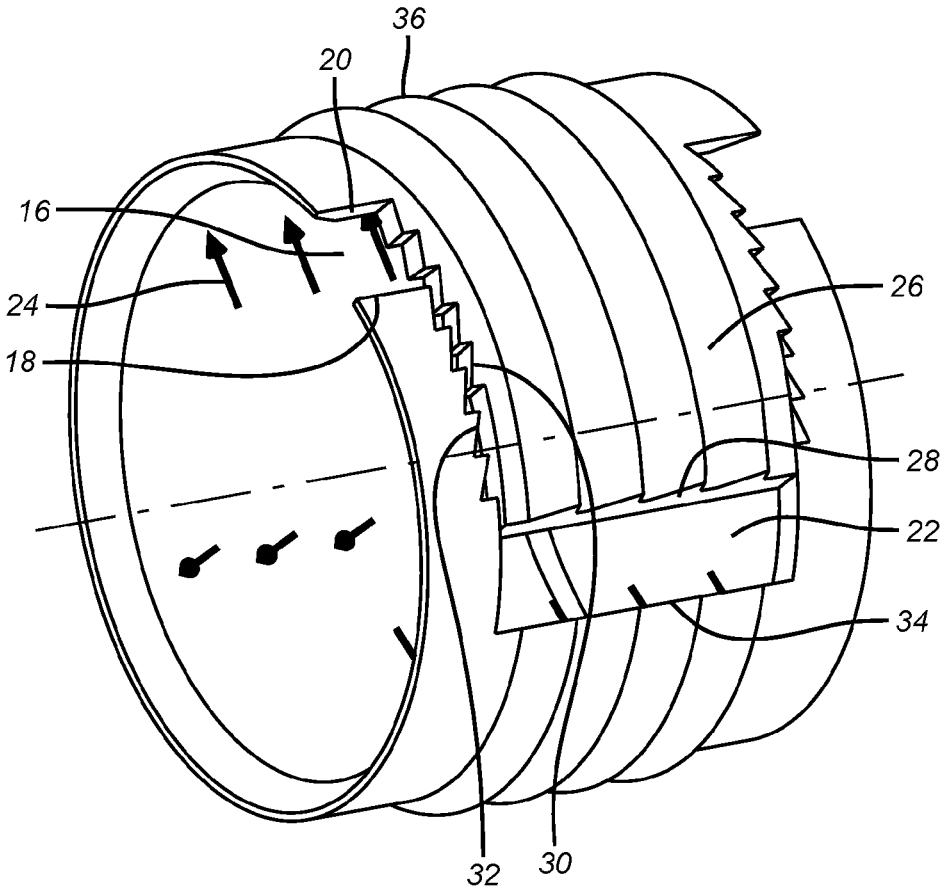
FIG. 2 is the view of FIG. 1 with the scroll expanded.

The barrier 10 has a tubular shape with a passage 12 therethrough. Surrounding the passage 12 is a tapered surface that can act as a ball seat 14 that can accept an object such as a ball that is not shown. In FIG. 1 the seat 14 extends continuously for 360 degrees but when the barrier 10 has its diameter increased as in FIG. 2 a small gap 16 can open up. Alternatively end 18 can start out under end 20 in the FIG. 1 position so that in the FIG. 2 position end 18 is still under or abuts end 20. In the event the ends 18 and 20 overlay on expansion or nearly abut with a small radial offset there will be a discontinuity of contact with the ball that is not shown when it lands on the seat 14. Since the objective is to substantially obstruct the passage 12 with the ball leakage is tolerated whether through the gap 16 as shown in FIG. 2 or with a radial offset between ends 20 and 18. The treatment can still go on effectively even with some moderate amount of flow through passage 12 either through gaps in seat 14 or gaps such as 22 that open up when an expansion force is applied or released as indicated schematically by arrows 24. Such expansion force can come from a tool such as an inflatable for example. Alternatively the barrier 10 may have a restraint to allow it to have a smaller dimension of FIG. 1 for running in followed by removal of the restraint either with applied force or by having a retaining member fail on exposure to well fluids to allow the stored potential energy to increase the dimension of the barrier 10. Another possibility is to use a shape memory alloy that crosses a critical temperature in the borehole to assume the FIG. 2 enlarged diameter configuration.

The barrier 10 has an elongated tab 26 with an end 28 and a ratchet profile 30 visible on the left side of FIG. 2. In the preferred embodiment the opposite side will have the same structure as described for the left side of FIG. 2. A mating ratchet pattern 32 allows tab 26 to slide with respect to end 34 as the diameter enlarges bringing the outer surface 36 part of which is on tab 26 into contact with the surrounding tubular. Preferably the outer surface will have surface roughness, hard facing, carbide, adhesive or other materials that can get a firm grip on the surrounding tubular so that a ball landed on seat 14 can withstand large pressure differentials experienced during a treatment. Ratchets 30 and 32 allow for incremental diameter increase with minimal springing back.

The barrier 10 can be made of soft drillable materials such as metals or composites and in some applications plastics may be used. The increase in diameter can be 50% or more meaning that inventory can be kept low to handle a broad range of surrounding tubular inside diameters. Edges 28 and 34 preferably abut in the run in position of FIG. 1. Balls landed on seats 14 can be optionally blown through rather than flowed to surface or milled out or allowed to dissolve or disintegrate. While the ratchet mechanism is shown in spaced arcs on opposed sides of relatively moving ends the one way motion can be achieved with ratchets located elsewhere, such as between the relatively moving ends, or the mechanism can be other than opposing teeth permitting only one way relative movement such as a wedge sliding in one direction and digging in when the relative movement direction reverses.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc. Another operation can be production from said zone or injection into said zone.

The above description is illustrative of the preferred embodiment and many modifications may be made by those skilled in the art without departing from the invention whose scope is to be determined from the literal and equivalent scope of the claims below:

We claim:

1. A barrier for selective isolation against a borehole wall at a subterranean location, comprising:

a longitudinally split annular body having a passage therethrough selectively extendible from a run in dimension to a larger set dimension as a result of relative movement between opposed longitudinally oriented ends of said body moving away from each other which increases a diameter of said passage for fixation against the borehole wall and further comprising a locking feature preventing return to the run in dimension, said body further comprising a seat that accepts an object with said body in said set dimension for selectively occluding the borehole.

2. The barrier of claim 1, wherein:

said ends overlap in said run in and said set dimension.

3. The barrier of claim 2, wherein:

said locking feature comprises at least one ratchet mechanism.

4. The barrier of claim 3, wherein:

said at least one ratchet mechanism comprises a plurality of spaced ratchet mechanisms operating circumferentially as said opposed ends move relatively.

5. The barrier of claim 4, wherein:

said seat increases in diameter with said passage.

6. The barrier of claim 5, wherein:

said body has an outer surface comprising an anchoring feature for attachment or penetration into the borehole wall.

7. The barrier of claim 6, wherein:

said anchoring feature comprises at least one of surface roughness, hard facing, carbide and adhesive.

8. The barrier of claim 7, wherein:

said ratchet mechanism is disposed in an arc with said relative movement between said ends comprising movement on said arc.

9. The barrier of claim 1, wherein:

said locking feature comprises at least one ratchet mechanism.

10. The barrier of claim 9, wherein:

said at least one ratchet mechanism comprises a plurality of spaced ratchet mechanisms operating circumferentially as said opposed ends move relatively.

11. The barrier of claim 9, wherein:

said ratchet mechanism is in substantial alignment with an outer surface of said body.

12. The barrier of claim 9, wherein:

said ratchet mechanism is disposed in an arc with said relative movement between said ends comprising movement on said arc.

13. The barrier of claim 1, wherein:

said seat increases in diameter with said passage.

14. The barrier of claim 1, wherein:

said body has an outer surface comprising an anchoring feature for attachment or penetration into the borehole wall.

15. The barrier of claim 14, wherein:

said anchoring feature comprises at least one of surface roughness, hard facing, carbide and adhesive.

16. The barrier of claim 1, wherein:

said body is made of a metallic, ceramic or composite material.

17. The barrier of claim 1, wherein:

said body moves to said larger dimension in response to at least one of mechanical force from a tool in said passage, release of potential energy stored in said body and thermal effects at the subterranean location.

18. The barrier of claim 1, wherein:

said body is made of a shape memory alloy which in response to running in and heating above a critical temperature assumes the set dimension.

19. A method of selective isolation against a borehole wall at a subterranean location, comprising:

providing a barrier at a predetermined borehole location comprising a longitudinally split annular body having opposed longitudinally oriented ends, a passage therethrough selectively extendible from a run in dimension to a larger set dimension, a locking feature preventing return to the run in dimension, and a seat that accepts an object with the body in the set dimension for selectively occluding the borehole;

increasing a diameter of said passage by inducing relative movement between the opposed longitudinally oriented ends of the body moving away from each other for fixation against the borehole wall; and occluding the borehole by delivering an object onto the seat.

20. The method of claim 19, comprising performing a well treatment against said object on said seat.

21. The method of claim 20, comprising:

making said well treatment at least one of hydraulic fracturing, stimulation, tracer injection, cleaning, acidizing, steam injection, water flooding and cementing.

* * * * *